US006120422A

United States Patent [19]

Kiemer

[11] Patent Number: 6,120,422

[45] Date of Patent: Sep. 19, 2000

[54] BELT MOUNTED ARM EXERCISER

[76] Inventor: Ralph F. Kiemer, 11597 Wandering Pines Trail W., Jacksonville, Fla. 32258

[21] Appl. No.: 09/132,226

[22] Filed: Aug. 11, 1998

[51] Int. Cl.[7] ..... A63B 21/012

[52] U.S. Cl. ..... 482/114; 482/115; 482/118

[58] Field of Search ..... 482/114–116, 118, 482/124

[56] References Cited

U.S. PATENT DOCUMENTS

| | | | |
|---|---|---|---|
| 4,618,139 | 10/1986 | Haaheim | 482/114 |
| 5,328,432 | 7/1994 | Gvoich | 482/118 |
| 5,358,461 | 10/1994 | Bailey | 482/124 |
| 5,429,572 | 7/1995 | Brown | 482/116 |
| 5,509,879 | 4/1996 | Lanzagorta | 482/120 |
| 5,618,243 | 4/1997 | Marshall | 482/115 |

*Primary Examiner*—John Mulcahy
*Attorney, Agent, or Firm*—Alvin S. Blum

[57] ABSTRACT

An exerciser is mounted on a belt to be worn by a person while walking, sitting or running. A housing is mounted on the belt at the user's back. Two cords are wound on separate grooves in a disc rotatably mounted in the housing and wound in opposite directions. A handle is mounted at the free end of each cord. Each cord is conducted through low friction guideways mounted on the belt to the user's sides. Pulling on one handle unwinds that cord from the disc and winds the other cord on the disc. Pulling alternately on the handles rotates the disc in first one direction and then the other. Friction elements between the disc and the housing resist rotation. The amount of friction and the force required to pull the handles is adjustable as is the length of the cords.

5 Claims, 2 Drawing Sheets

BELT MOUNTED ARM EXERCISER

BACKGROUND OF THE INVENTION

This invention relates to exercisers, and more particularly to a user powered arm exerciser that is mounted on a belt.

Arm-exercisers are generally stationary devices being mounted to a wall or the floor so that they will not yield when a handle is pulled against a frictional or elastic force. Walking, jogging and running are recommended exercises for maintaining bone strength and cardiovascular fitness. They do little for upper body strength. Exercise time must be lengthened if upper body exercise at a stationary device must be done separately.

It would be desirable to have an upper body exerciser that could be used simultaneously while walking, jogging and the like.

SUMMARY OF THE INVENTION

It is accordingly an object of the invention to provide an arm exerciser that may be employed while the user is mobile, such as while walking, sitting, running, or doing vigorous aerbobic exercise. It is another object that the device be size and force adjustable.

The exerciser of the invention comprises a belt of adjustable length to fit various girths. At the rear of the belt is a pivotally mounted disc. Its rotation is restrained by adjustable friction elements. The disc has two circumferencial parallel grooves. Each groove receives a cord with one end anchored to the groove and a second end provided with a handle. Each cord is wound in the groove counter to the rotation of the other cord so that pulling the cord off the disc with one handle rotates the disc and winds the other cord onto the disc. By pulling alternately on the handles, the disc rotates first in one direction, then in the opposite direction. The amount of force required to pull on each handle is determined by adjustment of the frictional elements that resist disc rotation. The belt is provided with low friction guideways through which the cords pass from the disc at the rear of the belt to points adjacent the user's sides.

These and other objects, advantages and features of the invention will become more apparent when the detailed description is studied in conjunction with the drawings, in which like reference characters designate like elements in the various drawing figures.

DETAILED DESCRIPTION OF PREFERRED EMBODIMENTS

Figure 5:
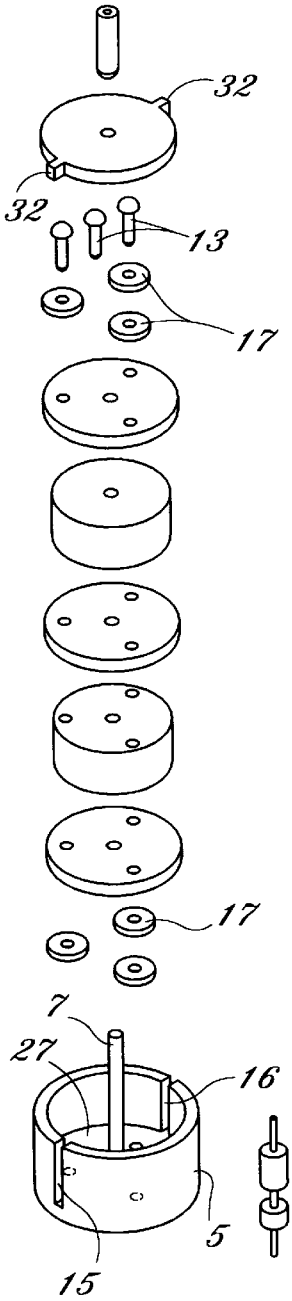
FIG. 5 is an exploded view of the disc and housing.
Figure 2:
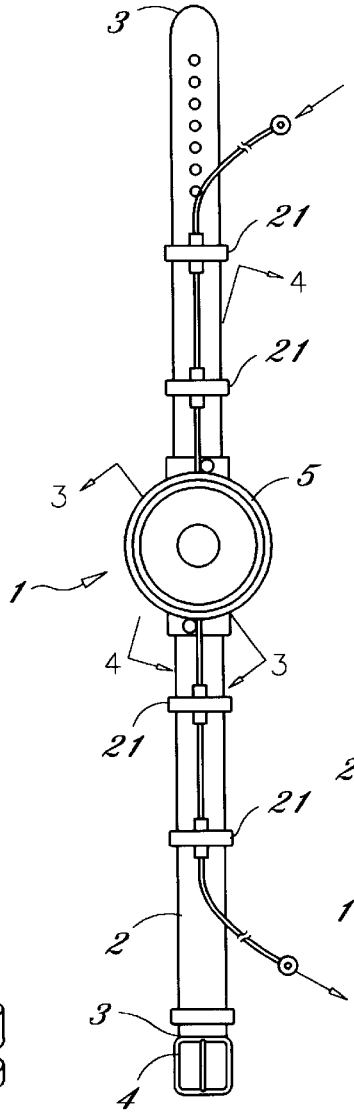
FIG. 2 is a plan view of the exerciser.
Figure 3:
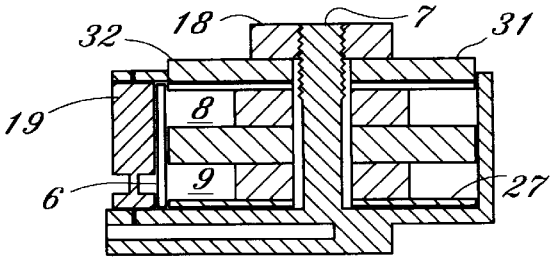
FIG. 3 is a sectional view through line 3—3 of FIG. 2.
Figure 4:
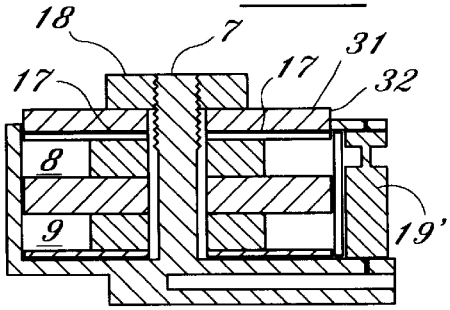
FIG. 4 is a sectional view through line 4—4 of FIG. 2.
Figure 1:
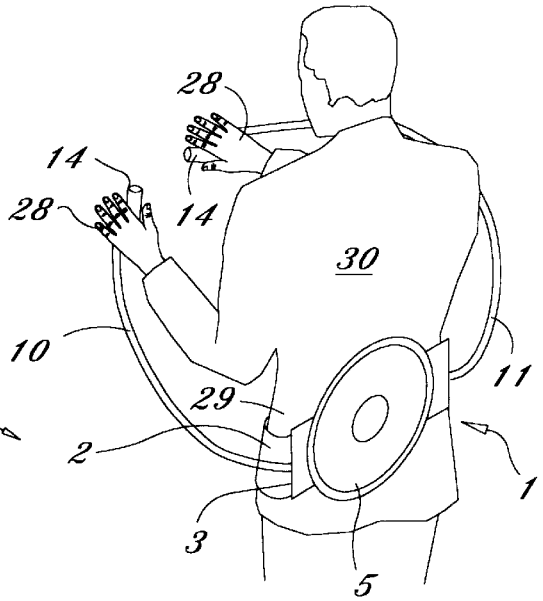
FIG. 1 is a diagrammatic perspective view of the exerciser in use by a stick figure.
Figure 6:
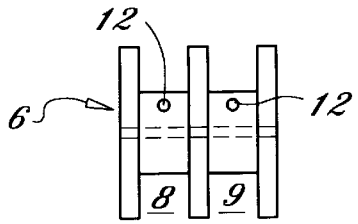
FIG. 6 is a side view of the disc.
Figure 7:
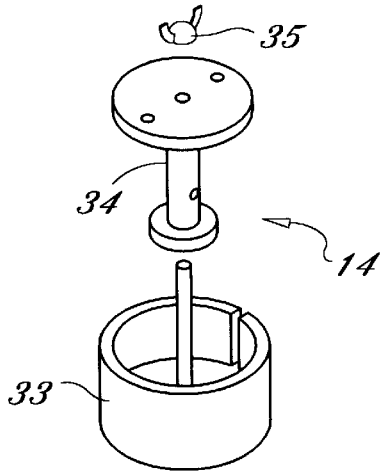
FIG. 7 is an exploded view of a handle of FIG. 2.
Figure 8:
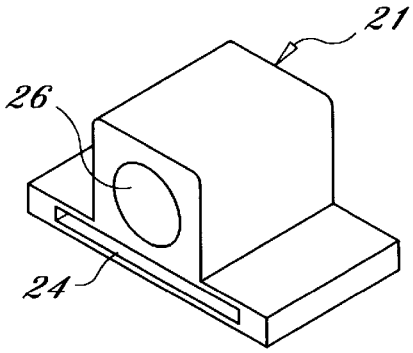
FIG. 8 is a perspective view of a guideway of FIG. 2.

Referring now first to FIG. 1, a user 30 wears the exerciser 1 by strapping the belt 2 around his/her waist 29 by adjusting the buckle 4 to draw the belt ends 3 snuggly together. The user grasps a handle 14 in each hand 28 and pulls one hand forward forcefully. This causes the handle in the other hand to be pulled toward the belt. Each handle 14 is attached to a cord 10 or 11. Movement of the cords is resisted by an adjustable friction mechanism within housing 5 mounted on the belt 2 at the user's back.

Referring now to FIGS. 2–8, the exerciser 1 comprises a belt 2 with ends 3 that may be adjustably secured with a buckle 4. Mounted on the belt are low friction guideways 21 that may be adjustably positioned on the belt. Preferably, one guideway is positioned at each side of the user. A slot 24 receives the belt. A cylindrical passage 26 receives the cord to which the handle 14 is attached. The cords 10,11 are woven of a lubricous material such as polyolefin. The guideway 21 may be molded of a similar lubricous material such as polypropylene or nylon, for example so that the cord passing back and forth through the guideway will be held in proper position on the belt and will slide easily without resistance and damage to the cord or the guideway.

Also mounted on the belt is housing 5. Extending upward from the housing base 27 is threaded shaft 7 upon which is rotatably mounted the disc 6. Disc 6 has two circumferencial grooves 8,9. The disc may be laminated from multiple individual discs as shown or formed in one piece by means well known in the art. A passage 12 with one enlarged end is formed in each groove. A cord is passed through each passage, the end knotted and the knot pulled into the enlarged end of the passage to anchor the cord end in the groove. A cord is then wound onto each groove, with one cord going clockwise and the other cord going counterclockwise.

Rivets 13 may join the laminates together to form the disc and may also fasten washers 17 of high friction material such as used in fishing reel drags to the top and bottom of the disc. A cover plate 31 is mounted on the shaft and an adjustment knob 18 is threadedly engaged on the shaft 7 to force the disc against the base 27 of the housing. As the cords are alternately pulled, the disc rotates in first one direction and then in the other. Friction between the rotating friction elements and the stationary cover and housing base resist the rotation. As the knob 18 is tightened, friction is increased, and more force is required to pull the handles. Tabs 32 on cover plate 31 extend into cord openings 15 and 16 on the housing to prevent cover plate 31 from rotating in the housing. Alternatively, the friction elements may be affixed to the stationary elements. Openings 15 and 16 in the housing provide a passage for the cord from grooves 9 and 8 respectively. Adjacent each opening is a low friction guideway 19, 19' including one or more rollers to guide the cord along the belt. One spool type roller guideway is shown. Multiple rollers (not shown) may be provided, as desired.

The handle 14 receives the free end of the cord. It is provided with cord length adjusting means in the form of a cylindrical housing 33 that rotatably receives take up spool 34 on which the cord is wound. Wing nut 35 locks the spool 34 in the housing and prevents rotation therein to fix the useful cord length to suit a user's arm length.

Figure 9:
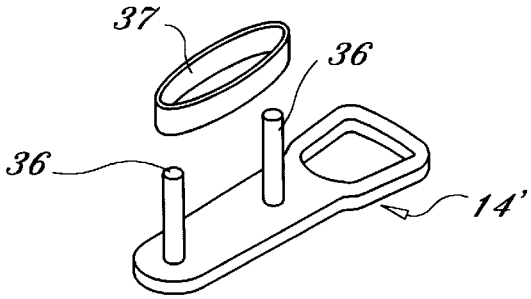
FIG. 9 is a perspective view of another embodiment of the handle.

Referring now to FIG. 9 an alternative handle 14' is shown with two upstanding studs 36. A loop is formed in the free end of the cord and slipped over one of the studs. The cord is then wound around the studs until a suitable cord length is reached. Then rubber band 37 is slipped over the studs to fix the cord length.

Figure 10:
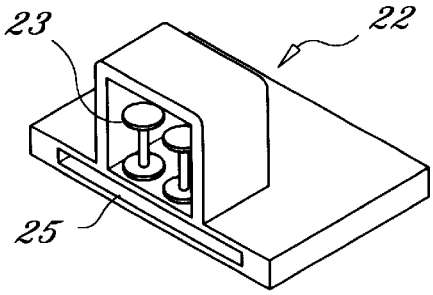
FIG. 10 is a perspective view of another embodiment of the guideway.

Referring now to FIG. 10, an alternative low friction guideway 22 is shown with a slot 25 to receive the belt and rollers 23 to position and guide the cord with reduced friction.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An exerciser to be worn around the waist of a user, the exerciser comprising:

A) a belt with belt ends;

B) buckle means for adjustably joining the belt ends together to secure the belt around the waist of a user;

C) a housing mounted on the belt intermediate the belt ends;

D) a disc rotatably mounted within the housing, the disc having a first circumferencial groove and a parallel second circumferencial groove;

E) a first elongate cord having a first cord end passing through a first opening in the housing and received and anchored in the first groove, and having a second cord end provided with a handle;

F) a second elongate cord having a first cord end passing through a second opening in the housing and received and anchored in the second groove, and having a second cord end provided with a handle, the first and second openings in the housing being substantially diameterally opposed, the first and second cords being wound in opposite directions in their respective grooves such that pulling on one handle unwinds the cord attached thereto from the disc and winds the other cord onto the disc;

G) adjustable friction means interposed between the disc and the housing for frictionally resisting rotation of the disc within the housing when one of the handles is pulled; and H) reduced friction guideway means encircling the first cord and the second cord for providing a low friction path for cord motion as the first and second cords move back and forth when alternately pulled by the handles.

2. The exerciser according to claim 1 further comprising a cord length adjusting means attached to each handle for adjusting the length of cord extending from each handle to the housing.

3. The exerciser according to claim 2, in which the guideway means includes a low friction guideway mounted at each said first and second openings in said housing and at least two belt mounted low friction guideways.

4. The exerciser according to claim 1, in which the guideway means includes a low friction guideway mounted at each said first and second openings in said housing and at least two belt mounted low friction guideways.

5. An exerciser to be worn around the waist of a user, the exerciser comprising:

A) a belt with belt ends;

B) buckle means for adjustably joining the ends together to secure the belt around the waist of a user;

C) a first elongate cord having a first cord end connected to the belt, and having a second cord end provided with a handle for grasping by a first hand of a wearer of the belt;

D) a second elongate cord having a first cord end connected to the belt, and having a second cord end provided with a handle for grasping by a second hand of a wearer of the belt; and E) bidirectional extension resisting means attached to the belt for providing exercise enhancing resistance to moving each handle away from the belt, the resisting means including a single rotary element attached to the belt, the first and second cords being wound in opposite directions on the rotary element such that pulling on one handle unwinds the cord attached thereto from the rotary element and winds the other cord onto the rotary element.

* * * * *